United States Patent [19]

Herrington

[11] Patent Number: 4,832,507

[45] Date of Patent: May 23, 1989

[54] THERMOPLASTIC DRAW TAPE BAG HELD CLOSED BY MICROENCAPSULATED ADHESIVE

[75] Inventor: Fox J. Herrington, Holcomb, N.Y.

[73] Assignee: Mobil Oil Corporation, New York, N.Y.

[21] Appl. No.: 195,920

[22] Filed: May 19, 1988

[51] Int. Cl.[4] ..... B65D 33/28

[52] U.S. Cl. ..... 383/74; 383/75; 493/225

[58] Field of Search ..... 383/72, 73, 74, 75, 383/76, 61; 493/225

[56] References Cited

U.S. PATENT DOCUMENTS

| | | | |
|---|---|---|---|
| 916,802 | 3/1909 | Thompson | 383/74 |
| 1,095,790 | 5/1914 | Blumel | 383/74 |
| 2,551,044 | 5/1951 | Ottinger et al. | 493/225 |
| 3,029,853 | 4/1962 | Piazze . | |
| 3,547,341 | 12/1970 | Kirkpatrick . | |
| 3,738,568 | 6/1973 | Ruda . | |
| 4,260,003 | 4/1981 | Hendrickson | 383/72 |
| 4,349,104 | 9/1982 | Hayes | 383/76 |
| 4,624,654 | 11/1986 | Boyd et al. . | |

FOREIGN PATENT DOCUMENTS

| | | |
|---|---|---|
| 1125363 | 8/1968 | United Kingdom . |

*Primary Examiner*—Stephen P. Garbe
*Attorney, Agent, or Firm*—Alexander J. McKillop; Charles J. Speciale

[57] ABSTRACT

A thermoplastic draw tape bag having a microencapsulated adhesive on the inside surface of each hem of the bag. The adhesive has the characteristic that when the draw tape is withdrawn from the hem thereby causing the hem to gather, the tape pulls easily until it is tight whereupon further pulling of the draw tape causes the adhesive capsules to be broken thereby gluing together the tape and the hem and holding the bag closed.

7 Claims, 1 Drawing Sheet

THERMOPLASTIC DRAW TAPE BAG HELD CLOSED BY MICROENCAPSULATED ADHESIVE

FIELD OF THE INVENTION

The invention relates to the manufacture of flexible bags and particularly to the manufacture of draw tape bags from thermoplastic films wherein the bags are held closed without tying the draw tapes.

BACKGROUND OF THE INVENTION

Bags made of plastic film such as thin polyethylene film have been used in various sizes. Small bags are used in the packaging of sandwiches and the like; larger bags are used for shopping bags and even larger bags are used for containing trash. The present invention is particularly related to a draw tape bag having a microencapsulated adhesive in the draw tape hem for preventing the bag from inadvertently coming open.

A particularly advantageous closure for such bags includes a draw band or tape constructed from the same polyethylene material. Draw tape bags of this type have been known for several years and are described in various patents such as, for example, U.S. Pat. No. 3,029,853-Piazze. Bags of this type are formed by two pliable plastic sheets joined to one another on three sides and open at a fourth. The tubular hem is provided at the open end and of each sheet and contains a pliable thermoplastic strip. A hole or opening at the center of each hem exposes the strip in the hems allowing them to be pulled through the opening and used as a handle while simultaneously closing the open mouth of the bag. A similar type bag is disclosed in U.S. Pat. No. 4,624,654-Boyd et al. Draw tapes in the bags disclosed in these patents are at the same level in both hems of the bag. Draw tape bags using two tapes at different parallel levels in the bags are disclosed in U.S. Pat. No. 3,547,341-Kirkpatrick and Pat. No. 3,738,568-Ruda. In both of these patents the openings for pulling the draw tapes are at the opposite ends of the bag.

The present invention is also applicable to bags of the types disclosed in Broderick et al application Ser. No. 100,648, filed Sept. 24, 1987 entitled "Dual Draw Tape Bag and Method of Manufacture", Broderick et al application Ser. No. 100,649, filed Sept. 24, 1987 entitled "Draw Tape Bag with Two Single Tapes" and Broderick et al application Ser. No. 115,308, filed Nov. 2, 1987, entitled "Draw Tape Bag with Two Single Wraparound Draw Tapes and Method of Manufacture", all assigned to the assignee of the present application and incorporated herein by reference thereto.

RELATED APPLICATIONS

The present invention is related to the invention disclosed in Herrington application Ser. No. 07/195,921 entitled "Thermoplastic Draw Tape Bag With Tacky Tape", and the invention disclosed in Herrington et al application Ser. No. 07/195,919 entitled "Thermoplastic Draw Tape Bag with Tacky Closure Surface" all assigned to the assignee of the present application and concurrently filed herewith and incorporated herein by reference thereto.

It is an object of the present invention to provide a thermoplastic draw tape bag in which the inside of the hems for the draw tape is coated with microencapsulated adhesive so that when the tape is pulled tight, the adhesive is activated, gluing the tape to the inside of the hem so that the bag stays closed after the draw tape is pulled tight. Thus there is no need to tie the tapes.

SUMMARY OF THE INVENTION

In accordance with the present invention, there is provided a thermoplastic draw tape bag comprising two panels forming an open top, closed bottom bag, the panels being joined along the sides of the bag, a hem on the panels being folded over adjacent the top to receive a draw tape, the bottom of the hem being secured to the adjacent panel, a draw tape in each hem having at least one end secured at one side of said panels, each said draw tape being accessible for pulling through an opening in the respective hem of the bag to withdraw the draw tape from the hem to close the open top of the bag, and a microencapsulated adhesive on the inside surface of each hem, said adhesive having the characteristics that when the draw tape is withdrawn from the hem causing the hem to gather, the tape pulls easily until it is tight, whereupon further pulling at the draw tape causes the adhesive capsules to be broken thereby gluing together the tape and the hem and holding the bag closed.

The foregoing and other features and advantages of the invention will be better understood from the following more detailed description and appended claims.

DESCRIPTION OF THE PREFERRED EMBODIMENT

The plastic draw tape bags of the present invention may be made of any suitable thermoplastic material such for example as high density polyethylene or from linear low density polyethylene or equivalent plastic materials. In the preferred form of the invention the bags are formed from a tube of polyethylene which is oriented in the direction of extrusion. Such materials for plastic bags are disclosed in U.S. Pat. No. 4,558,463-Boyd. Apparatus suitable for manufacturing draw tape bags of the present invention is disclosed in U.S. Pat. No. 4,625,654-Boyd et al and the disclosure therein is incorporated herein by reference thereto.

Figure 1:
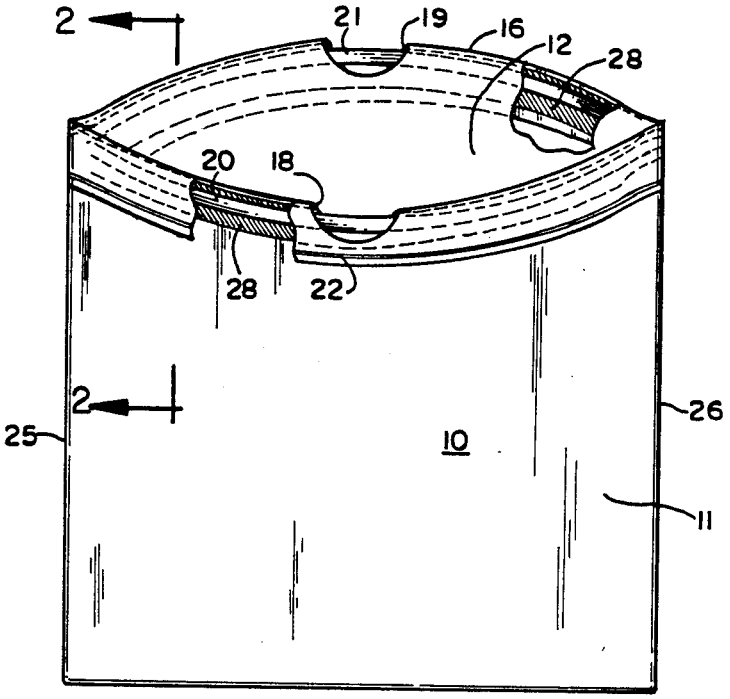
FIG. 1 is a perspective view of a draw tape bag having a microencapsulated adhesive in the draw tape hem embodying the present invention.
Figure 2:
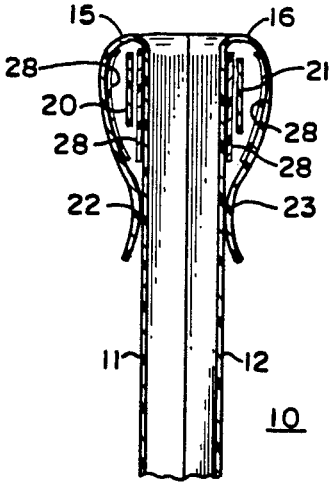
FIG. 2 is a sectional view taken along the lines 2—2 in FIG. 1.

Referring to FIGS. 1 and 2 it will be seen that a draw tape bag 10 according to the present invention includes a front panel 11 and a rear panel 12. The two panels are preferably formed from a tube of polyethylene which is oriented in the direction of extrusion. The bottom 13 of the bag 10 may be formed by a fold or heat seal joining the front and back panels 11 and 12. The tube is slit along the top and the two longitudinal free edges are folded over respectively against the adjoining panels 11 and 12 to provide an open mouth comprising a pair of longitudinal hems 15 nd 16 of double layer thickness opposite the longitudinal fold edge of bottom 13. As shown in FIGS. 1 and 2 the hems 15 and 16 are provided with openings or holes 18 and 19 for access to the draw tapes 20 and 21 inserted in the respective hems. After the draw tape 20 and 21 have been inserted in the respective hems 15 and 16, the double layer thickness of each hem is longitudinally joined together along seal lines 22 and 23 to form opposed tubular channels each containing one of the draw tapes 20 and 21 respectively.

The ends of the draw tapes 20 and 21 are secured to the respective sides of the bag 10 when the side heat seals 25 and 26 are made.

As may be seen in FIGS. 1 and 2 a microencapsulated adhesive coating or surface 28 is applied to the inside surface of the hems 15 and 16 at the top of the bag and this adhesive surface 28 extends around the inside periphery of the hems. The surface 28 comprises a microencapsulated adhesive such for example as an epoxy in capsule form having the characteristic of being activated when the adhesive capsules are broken. Microencapsulated adhesives of the foregoing type are similar to the "fastened adhesives" manufactured by Minnesota Mining & Manufacturing Co. and sold to licensed applicators for bolting seat belts in motor vehicles. When each of the draw tapes 20 and 21 is withdrawn from its respective hem, the tape pulls easily until it is tight. At this point, firm pulling on the tape causes the adhesive capsules to be broken, so they glue together the tape and the hem, holding the bag closed. It is to be understood that at least a portion of the tape adjacent the sealed ends may also be coated with the adhesive 28 for additional holding. It is also to be understood that the adhesive coating 28 may comprise other equivalent materials so long as they have the characteristic of being activated when subjected to pressure and being adapted to seal together the tape and the hem and hold the bag closed after the draw tape is pulled tight. Thus the need to tie the tapes is eliminated.

While the draw tape bag illustrated in the drawing is of the type having an opening in the hem intermediate the ends of the hem, it is to be understood that the present invention is applicable to other types of draw tape bags including those where the opening in the hem may be located at the ends of the hem rather than intermediate the ends of the hem.

What is claimed is:

1. A thermoplastic draw tape bag comprising;

two thermoplastic panels forming an open top, closed bottom bag, said panels being joined along the sides of said bag;

a thermoplastic hem on said panels being folded over adjacent said top to receive a draw tape, the bottom of said hem being secured to the adjacent panel;

a draw tape in each hem having at least one end secured at one side of said panels, each said draw tape being accessible for pulling through an opening in the respective hem of said bag to withdraw said draw tape from said hem to close said open top of said bag; and a microencapsulated adhesive on the inside surface of each hem, said adhesive having the characteristic that when the draw tape is withdrawn from the hem causing the hem to gather the tape pulls easily until it is tight whereupon further pulling of the draw tape causes the adhesive capsules to be broken thereby gluing together the tape and the hem and holding the bag closed.

2. A draw tape bag according to claim 1 wherein said adhesive comprises a coating extending around the peripheral inside surface of each hem.

3. A draw tape bag according to claim 1 wherein each said draw tape has a microencapsulated adhesive coating adjacent the secured end.

4. A thermoplastic draw tape bag comprising:

a thermoplastic film forming an open top, closed bottom bag;

a hem on said bag being folded over adjacent said top to form an open mouth for said bag, the bottom of said hem being secured to the side of the bag;

a thermoplastic draw tape in said hem, said draw tape being accessible for pulling through an opening in the hem of said bag to withdraw said draw tape from said hem to close said open mouth of said bag; and a microencapsulated adhesive on the inside surface of said hem, said adhesive having the characteristic that when the draw tape is withdrawn from the hem causing the hem to gather, the tape pulls easily until it is tight whereupon further pulling of the draw tape causes the adhesive capsules to be broken thereby gluing together the tape and the hem and holding the bag closed.

5. A draw tape bag according to claim 4 wherein said adhesive comprises a coating extending around the peripheral inside surface of said hem.

6. A draw tape bag according to claim 4 wherein said draw tape has a microencapsulated adhesive coating extending along a portion of the length thereof.

7. A thermoplastic draw tape bag comprising:

a thermoplastic film forming an open top, closed bottom bag;

a hem on said bag being folded over adjacent said top to form an open mouth for said bag, the bottom of said hem being secured to the side of the bag;

a thermoplastic draw tape in said hem and engaging the inside surface of said hem said draw tape being accessible for pulling through an opening in the hem of said bag; and a microencapsulated adhesive coating on one of said surfaces of said draw tape and said hem, said adhesive having the characteristic that when the draw tape is withdrawn from the hem causing the hem to gather, the tape pulls easily until it is tight whereupon further pulling of the draw tape causes the adhesive capsules to be broken thereby gluing together the tape and the hem and holding the bag closed.

* * * * *